US009487903B2

(12) United States Patent
Huerth et al.

(10) Patent No.: US 9,487,903 B2
(45) Date of Patent: Nov. 8, 2016

(54) WASHING MACHINE SOAP AND CHEMICAL DISPENSER WITH IMPROVED FLUSHING

(75) Inventors: Andrew Huerth, Green Lake, WI (US); Travis Lindgren, Neenah, WI (US)

(73) Assignee: Alliance Laundry Systems LLC, Ripon, WI (US)

( * ) Notice: Subject to any disclaimer, the term of this patent is extended or adjusted under 35 U.S.C. 154(b) by 1258 days.

(21) Appl. No.: 13/351,891

(22) Filed: Jan. 17, 2012

(65) Prior Publication Data

US 2013/0180293 A1 Jul. 18, 2013

(51) Int. Cl.
*D06F 39/02* (2006.01)
*D06F 39/08* (2006.01)

(52) U.S. Cl.
CPC ..... *D06F 39/02* (2013.01); *D06F 39/028* (2013.01); *D06F 39/088* (2013.01)

(58) Field of Classification Search
CPC ..... D06F 39/02
See application file for complete search history.

(56) References Cited

U.S. PATENT DOCUMENTS

2005/0235703 A1* 10/2005 Cho et al. ..... 68/17 R
2009/0119849 A1* 5/2009 Hill et al. ..... 8/158

FOREIGN PATENT DOCUMENTS

DE 10150877 A1 * 7/2002 ..... D06F 39/08
EP 2239364 A1 * 10/2010 ..... D06F 39/02

* cited by examiner

*Primary Examiner* — Michael Barr
*Assistant Examiner* — Jason Riggleman
(74) *Attorney, Agent, or Firm* — Leydig, Voit & Mayer, Ltd.

(57) ABSTRACT

A washing machine soap and chemical dispenser having a housing bottom, a top having a plurality of water inlets, and a pull tray for receiving and dispensing soap and chemicals during a washing operation. The top has a plurality of passageways communicating between the water inlets and the compartments and a flush water passageway communicating about sides of the dispenser top adjacent the outer perimeter thereof for flushing the housing bottom and tray with water free of soap and chemicals during each washing operation. The dispenser further includes at least one flush passageway having an outlet port for directing flushing water between rear walls of the tray and housing.

17 Claims, 15 Drawing Sheets

WASHING MACHINE SOAP AND CHEMICAL DISPENSER WITH IMPROVED FLUSHING

FIELD OF THE INVENTION

The present invention relates generally to laundry washing machines, and more particularly, to laundry washing machines having a pullout dispenser tray or drawer for receiving soap, bleach, softeners, and the like and dispensing such products into a wash tub during a washing operation.

BACKGROUND OF THE INVENTION

Laundry washing machines, and particularly front loading washing machines, often have a soap and chemical additive dispenser which comprises a dispenser housing within the cabinet of the washing machine and a pullout tray or drawer that can be withdrawn outwardly of the cabinet for receiving soap and other chemicals for use during a washing operation. The tray has individual compartments for each soap or chemical and can be pulled outwardly of the housing to permit easy filling of the compartments. The tray can then be slid back into the dispenser such that during washing cycles water is selectively directed into the compartments for causing the soap or chemical to overflow the respective compartment into the bottom of the dispenser housing for direction into the wash tub.

Over time, residual soap and chemicals can accumulate on the bottom of the dispenser housing and about the tray which can cause mold or mildew and odors caused by such contaminants, requiring periodic cleaning of the dispenser tray and housing which can be tedious and time consuming. One approach for preventing such soap and chemical residual buildup has been to provide an outlet to the wash tub in front of the dispenser housing for enabling the direction of wash water under the tray. Such approach, however, requires additional space in the font of the machine which takes away from the needed drum capacity. It also does not flush with clean water, but only water that has previously gone through the soap and chemical compartments.

OBJECTS AND SUMMARY OF THE INVENTION

It is an object of the present invention to provide a washing machine having a soap and chemical dispenser adapted for a more reliable maintenance free operation.

Another object is to provide a washing machine as characterized above having a soap and chemical dispenser which more effectively cleans the dispenser of residual soap and chemicals during each washing operation.

A further object is to provide a washing machine of the above kind in which the soap and chemical dispenser is flushed with clean water free of the dispensed soap and chemicals during each cycle of operation.

Yet another object is to provide a washing machine having a soap and chemical dispenser of the foregoing type that is compact in design and does not alter the drum capacity of the machine.

Still a further object is to provide such a washing machine in which the soap and chemical dispenser is a relatively simple design and lends itself to economical manufacture.

Other objects and advantages of the invention will become apparent upon reading the following detailed description and upon reference to the drawings, in which:

Figure 1:
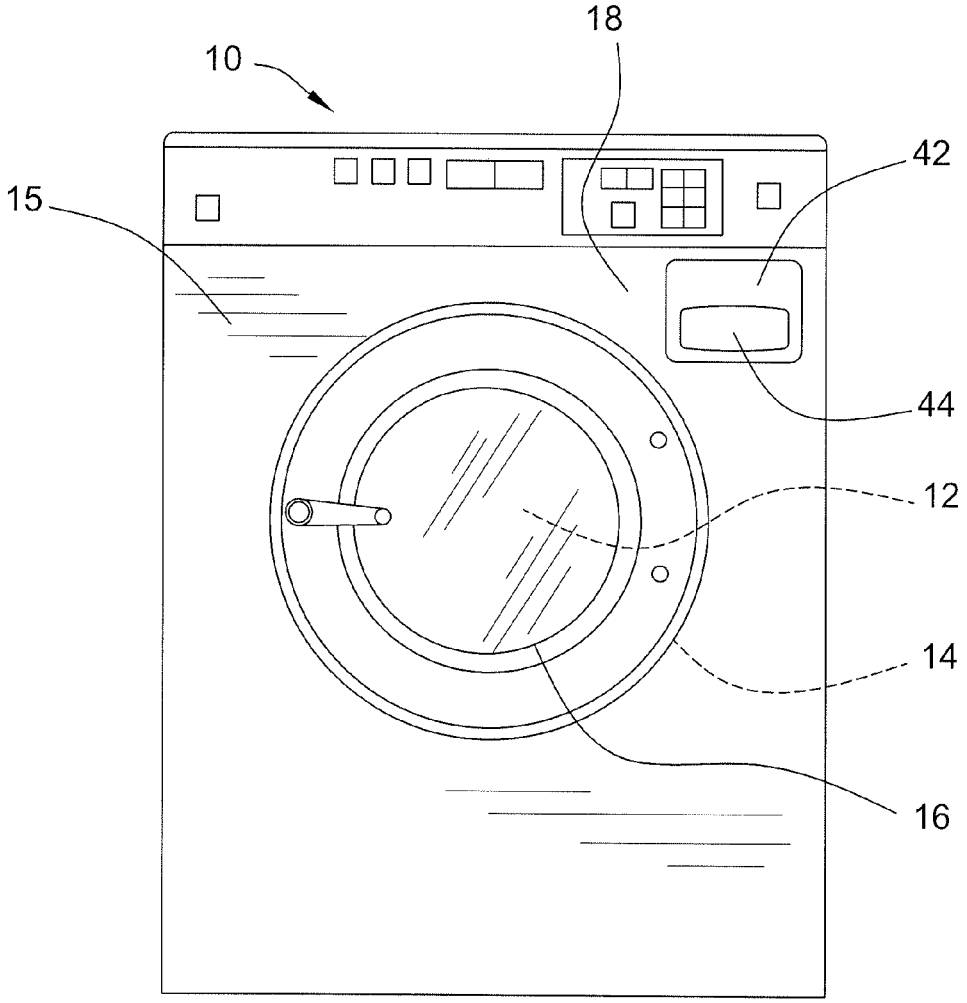
FIG. 1 is a front elevational view of a washing machine having a soap and chemical dispenser in accordance with the invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DESCRIPTION OF THE PREFERRED EMBODIMENTS

Referring now more particularly to the drawings, there is shown an illustrative washing machine 10 for washing clothes and other launderable items having a soap and chemical additive dispenser 11 in accordance with the invention. The illustrated washing machine 10 has a front opening cylindrical basket 12 disposed for rotation about a horizontal axis into which clothes or other items to be washed are introduced. The cylindrical basket 12 is disposed within a wash tub 14 in a conventional manner. The washing machine 10 has an outer cabinet 15 with a front opening door 16 for providing access to the basket 12.

Figure 2:
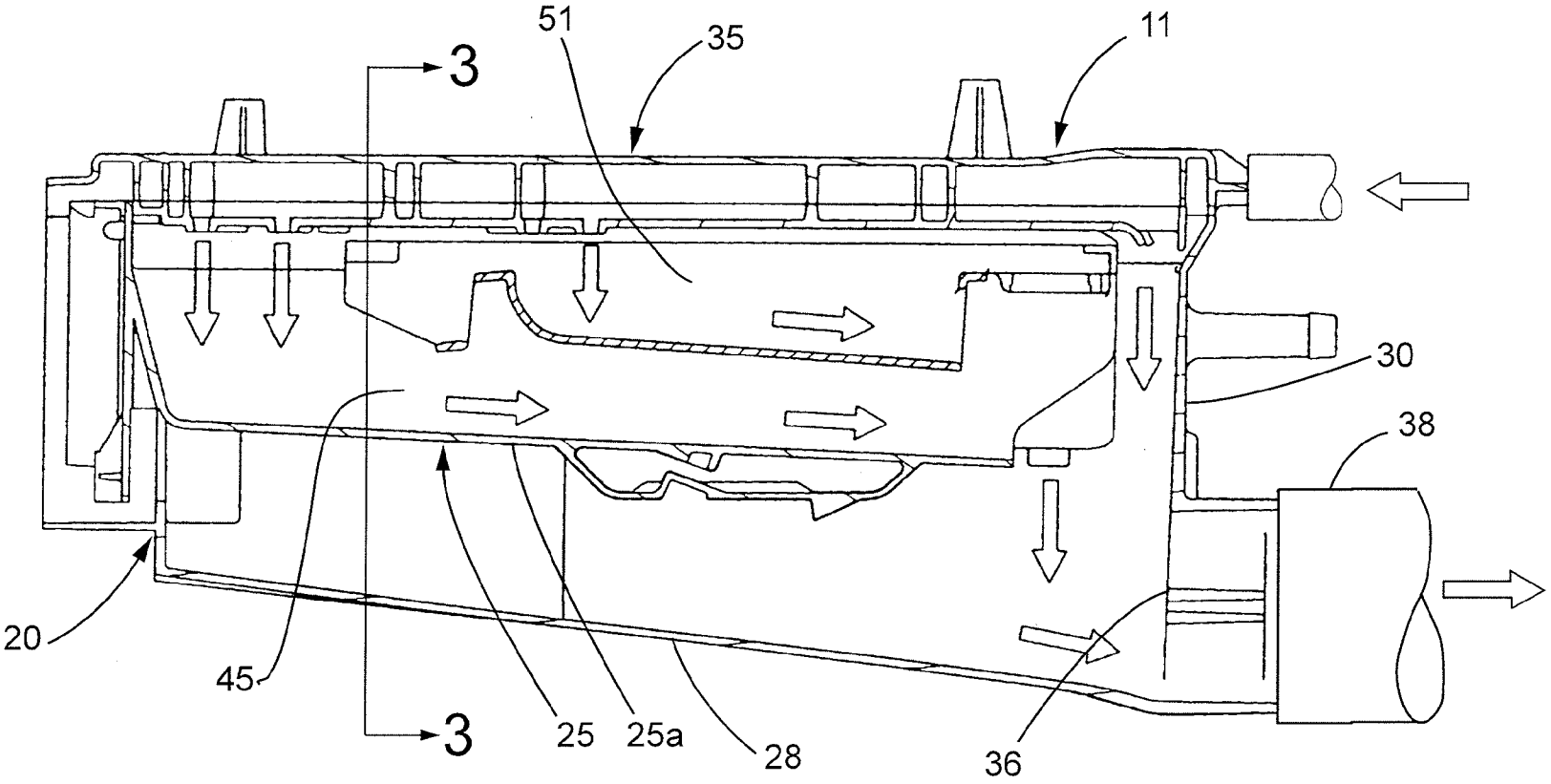
FIG. 2 is a longitudinal section of the soap and chemical dispenser of the illustrated machine.
Figure 3:
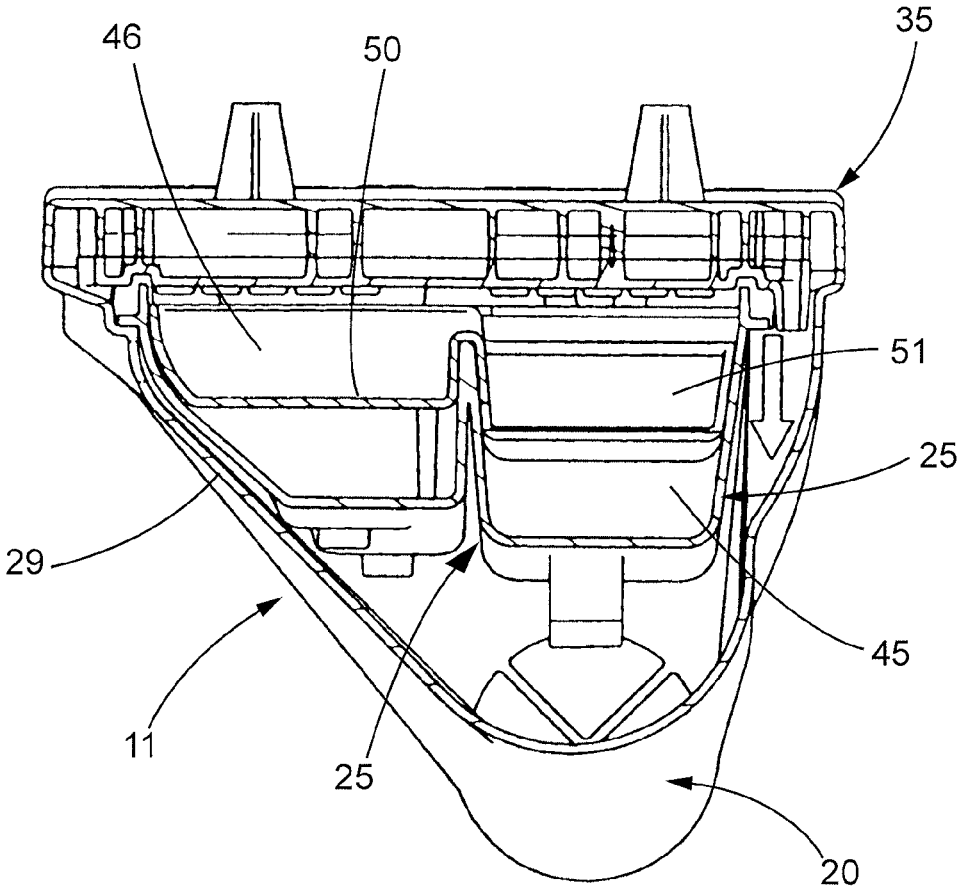
FIG. 3 is a vertical section of the dispenser taken in a plane of line 3-3 in FIG. 2.

For directing wash water to the washing tub 14 and simultaneously dispensing detergent and chemical additives into the wash water, the soap and chemical additive dispenser 11 is adjacent a front panel 18 of the cabinet 15 for easy access. The dispenser 11 in this case includes a housing 20 fixedly mounted in the cabinet 15 adjacent an access opening in the front panel and a compartmentalized tray or drawer 25 for receiving and containing soap and chemical additives (FIGS. 2 and 3). The tray 25 is movable between an operative inserted position within the dispenser housing 20 during operation of the washing machine and a pulled-out position to facilitate refilling of soap and chemicals.

Figure 4:
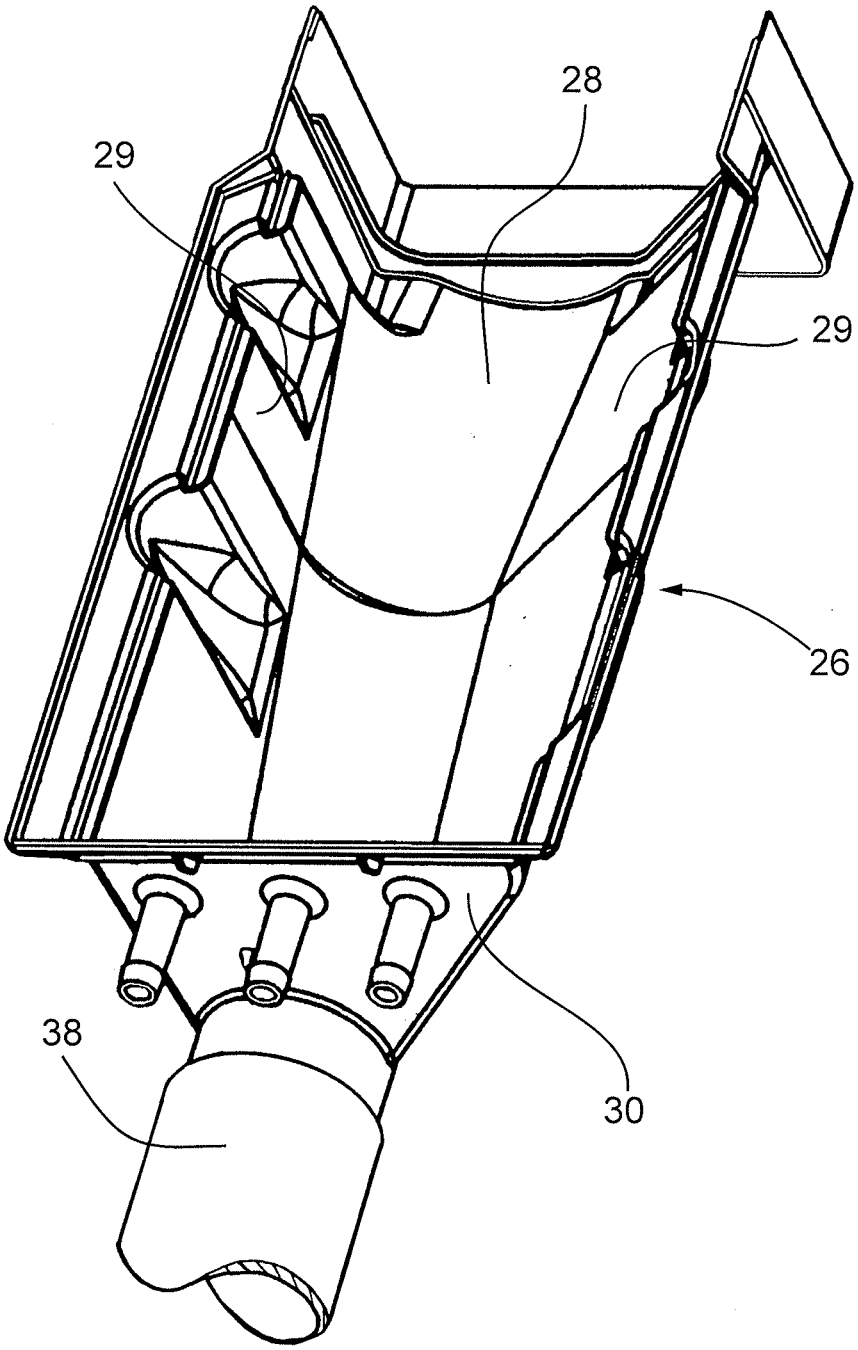
FIG. 4 is perspective of the housing bottom of the illustrated dispenser.
Figure 5:
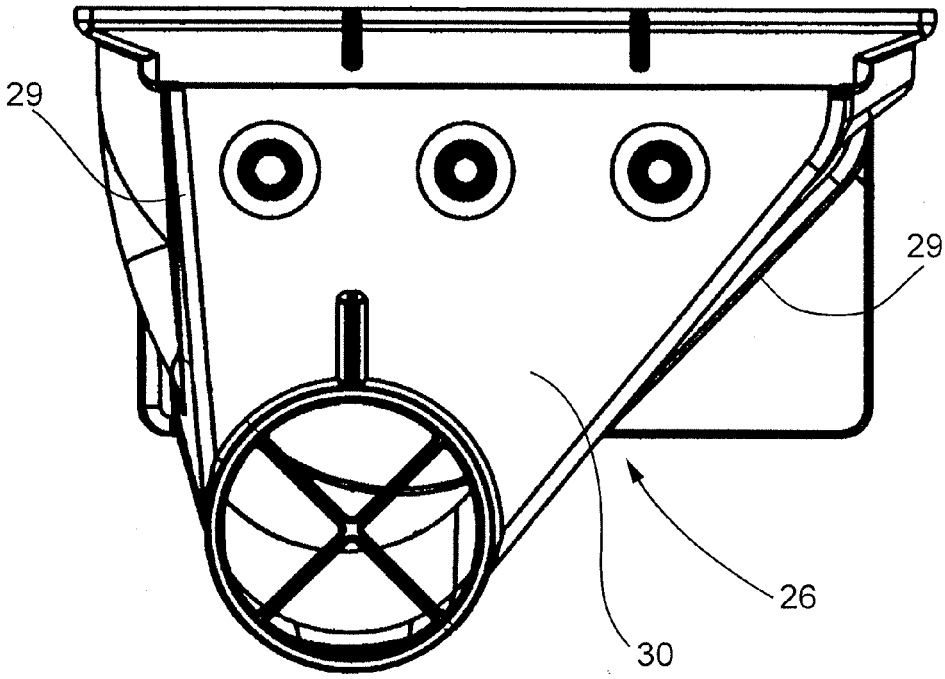
FIG. 5 is a rear end view of the housing bottom shown in FIG. 4.
Figure 6:
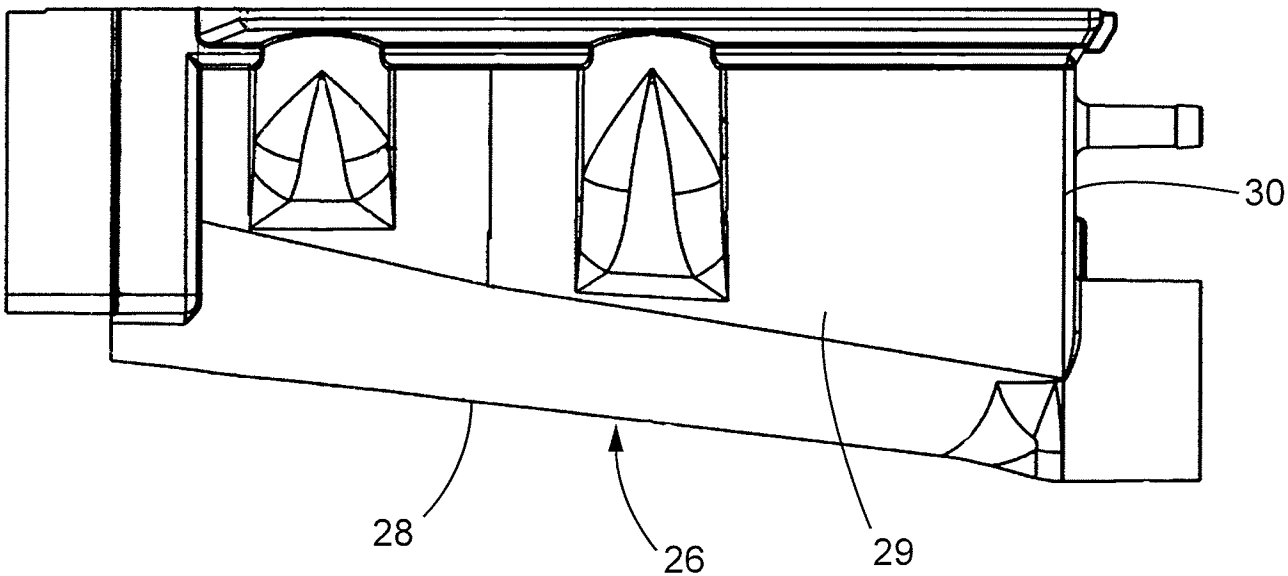
FIG. 6 is a side elevational view of the housing bottom shown in FIG. 4.

The illustrated dispenser housing 20 comprises a housing bottom 26 (FIGS. 4-6) having a bottom wall 28 with upstanding side walls 29 and a rear wall 30, which defines an upwardly opening chamber closed by a housing top or cover 35 (FIGS. 2 and 3). The bottom housing wall 28 tapers downwardly from the front of the dispenser for communicating liquid directed in the dispenser to an outlet 36 adjacent a bottom of the rear wall 30 which communicates with the wash tub 14 by way of an outlet hose 38.

Figure 7:
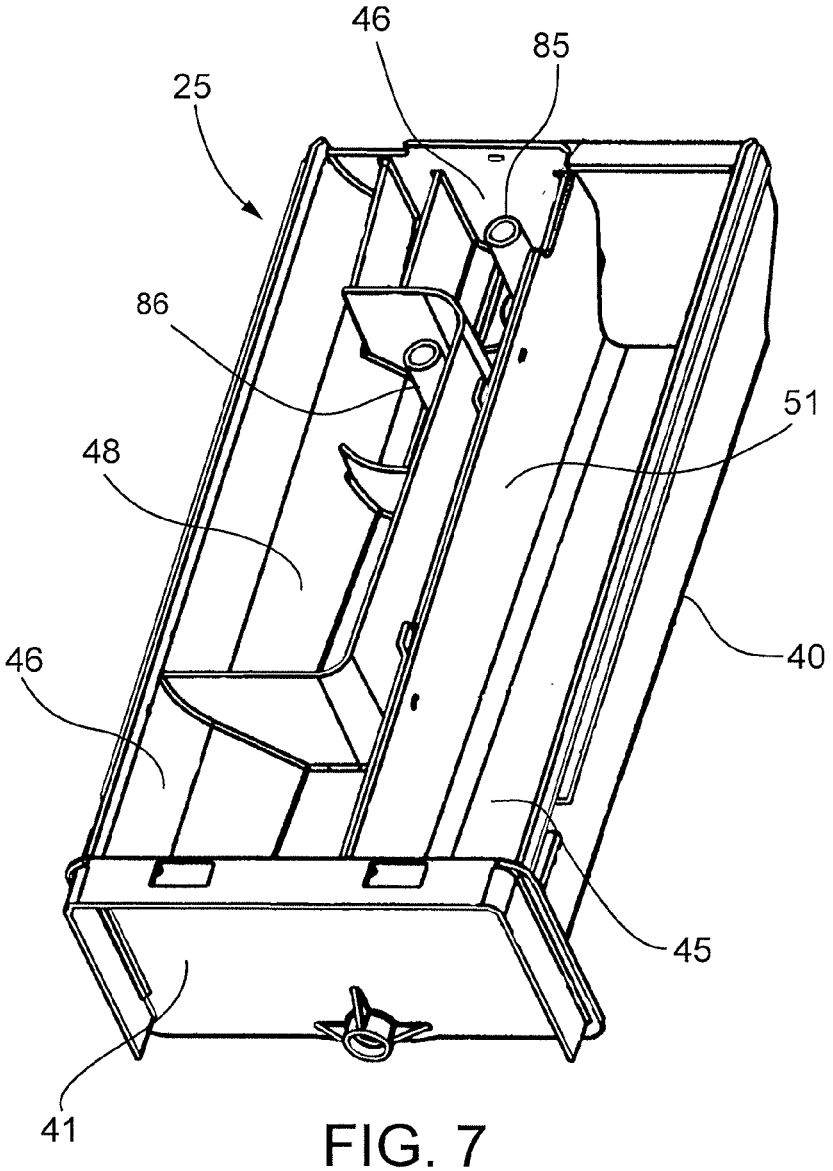
FIG. 7 is a perspective of the pull-out tray of the illustrated dispenser.

The tray 25 in this case comprises a bottom 40 (FIG. 7) having a front panel 41 to which a front plate 42 (FIG. 1) may be secured having a shape corresponding to the access opening in the housing and a handle or griping area 44 to facilitate sliding of the drawer between inserted and open positions. The tray bottom 40 in this case has a drawer configuration that defines a main wash soap compartment 45 on one side for receiving detergent for utilization during a wash cycle operation of the machine. The tray 25 further defines bleach and softener receiving compartments 46, 48, respectively, on a side opposite the main wash soap compartment 45. The tray 25 in this case has a raised or insert panel 50 formed with a pre-wash soap compartment 51 in partially overlying relation to the main soap compartment 45 for receiving soap for use in a pre-wash cycle.

Figure 15:
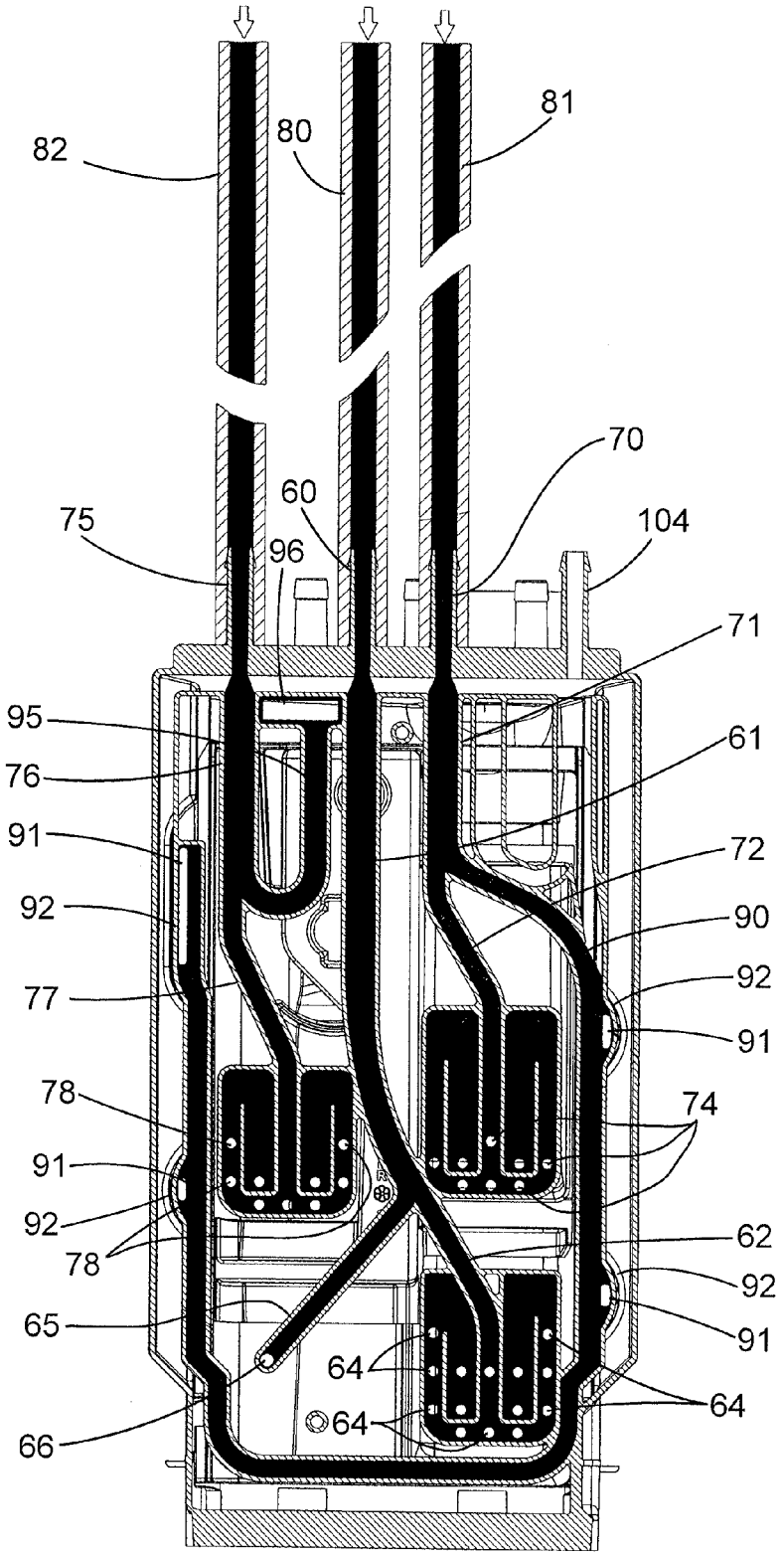
FIG. 15 is a partially diagrammatic depiction illustrating the liquid flow through the dispenser top.

For directing water to the soap and chemical compartments 45, 46, 48 and 51 of the dispenser tray 25 during selected cycles of operation of the washing machine, the dispenser housing top or cover 35 has a plurality of water supply inlets each connected to a respective water supply hose and water passageways for directing water to the compartments. More particularly, in the illustrated embodiment, the housing top or cover 35 has a two-part construction comprising upper and lower panels 55, 56 which are heat welded together to define the water passageways. In this case, the underside of the upper panel 55 and the upper side of the lower panel 56 each is formed with open sided channels 58, 59 which are disposed in abutting relation, and upon hot plate welding together, define sealed water passageways. In this instance, water inlets are formed in the upper panel 55. In the illustrated embodiment, as best depicted in FIG. 15, a main wash and bleach dispensing water inlet 60 communicates with a water passageway 61 having one leg 62 that communicates by means of a circuitous path with a plurality of outlet openings 64 for directing water into the main wash soap compartment 45 of the underlying tray 25 and a second leg 65 for channeling water to an outlet 66 for discharge into the bleach compartment 46 of the tray 25. For ease of reference, in FIG. 15, the passageways are darkened to depict the liquid flow. A prewash water inlet 70 communicates with a passageway 71 defined between the panels 55, 56, having one leg 72 which through a circuitous path communicates water through a plurality of outlets 74 to the prewash soap compartment 51 of the dispenser tray 25. A softener dispensing water inlet 75 communicates water through a water passageway 76, having a leg 77 which communicates through a circuitous path with a plurality of outlet openings 78 in a confined area or chamber for direction into the softener compartment 48 of the underlying dispenser tray 25.

As will be understood by a person skilled in the art, the direction of water to the inlets 60, 70, 75 may be controlled by respective control valves in each water supply line 80, 81, 82 for directing water into the prewash soap compartment 51, the main wash soap compartment 45, the bleach compartment 46, and the softener compartment 48, in appropriate timed relation with the washing cycle of the machine.

It can be seen that water directed into the prewash soap compartment 51, will overflow from the compartment 51 and drain through the dispenser outlet 36 and outlet hose 38 into the wash tub 14. Water directed into the main wash soap compartment 45 via the water line 80, inlet 60, and water passageway 61 will be directed into the main wash soap compartment 45 adjacent a forward end thereof, flow along the downwardly and rearwardly tapered bottom wall 25*a* of the tray 25 intermixing with detergent within the main soap compartment 45, and discharge from a discharge orifice 25*b* into the dispenser bottom 26 adjacent a rear end of the dispenser, again for direction through the outlet 36 and hose 38 to the wash tub 14. Water directed into the bleach water passageway 65 from the main wash/bleach dispensing water inlet 60 similarly communicates with the bleach compartment 46, and water directed into the softener water passageways 76, 77 from the softener dispensing water inlet 75 communicates with the softener compartment 48 of the tray 25.

Figure 8:
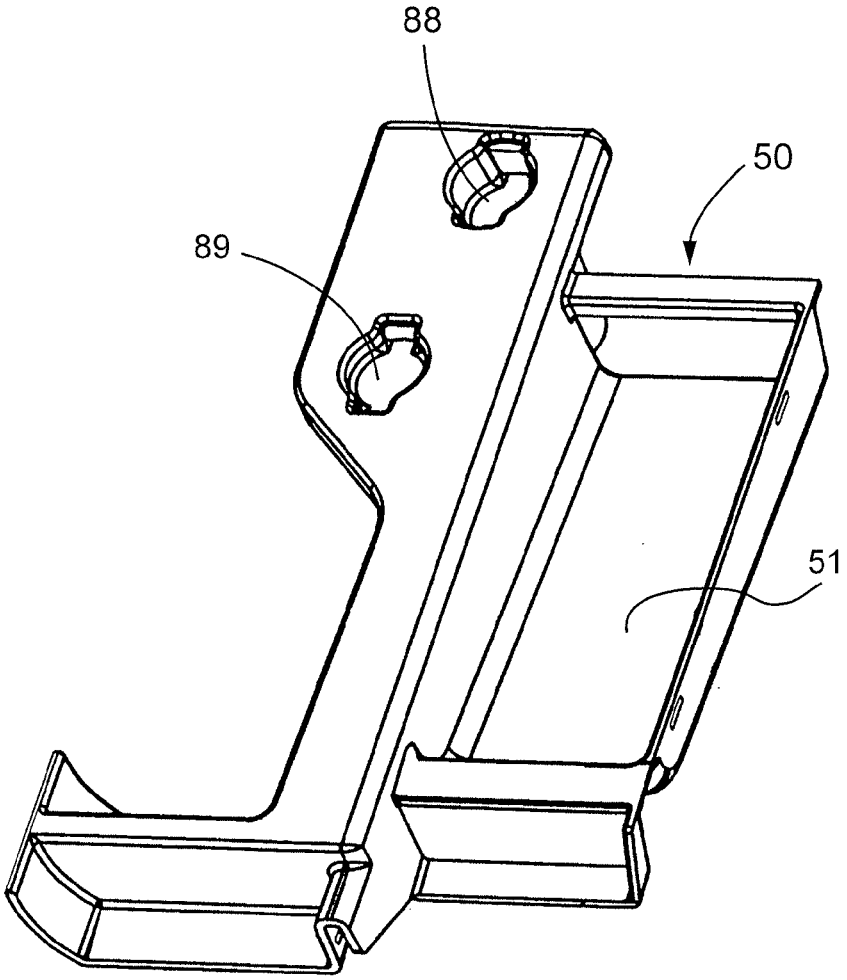
FIG. 8 is a perspective of a top insert of the illustrated tray.
Figure 9:
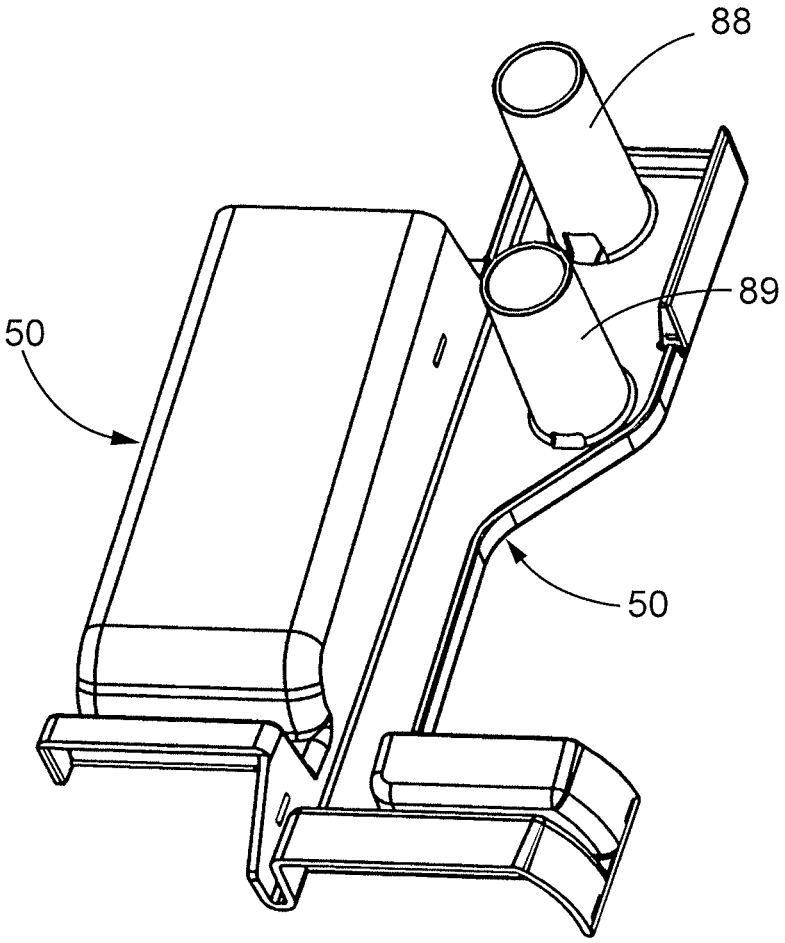
FIG. 9 is a bottom perspective of the tray insert shown in FIG. 8.
Figure 10:
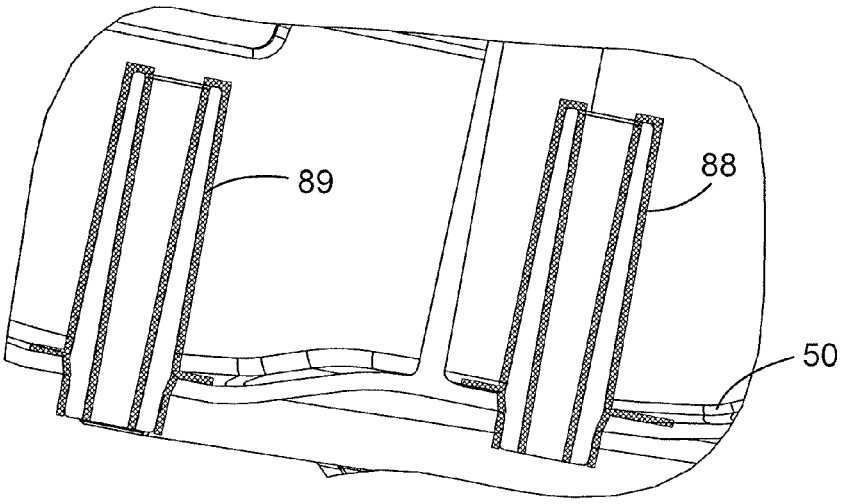
FIG. 10 is an enlarged fragmentary section of the siphoning tubes of the chemical-containing compartments of the illustrated tray.
Figure 11:
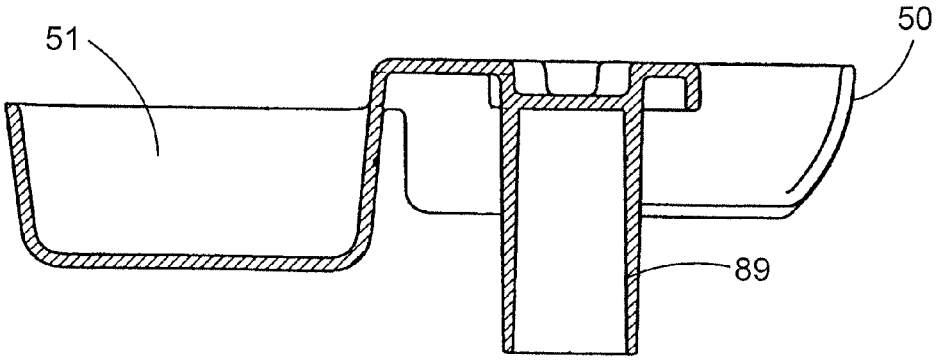
FIG. 11 is a vertical section of the tray insert showing one of the closed top downwardly opening siphoning columns.
Figure 12:
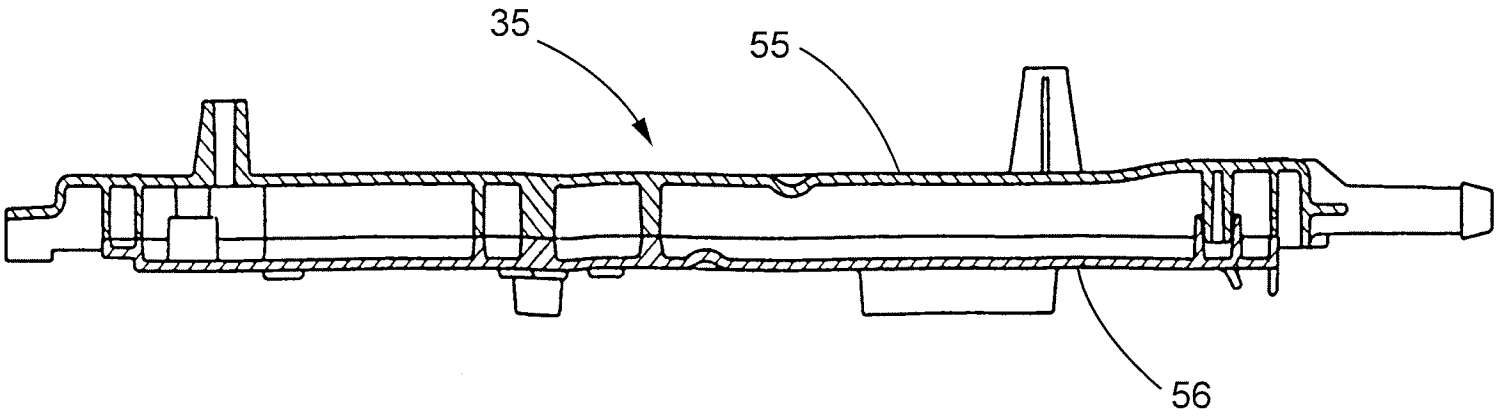
FIG. 12 is a longitudinal vertical section of the top of the illustrated dispenser.
Figure 13:
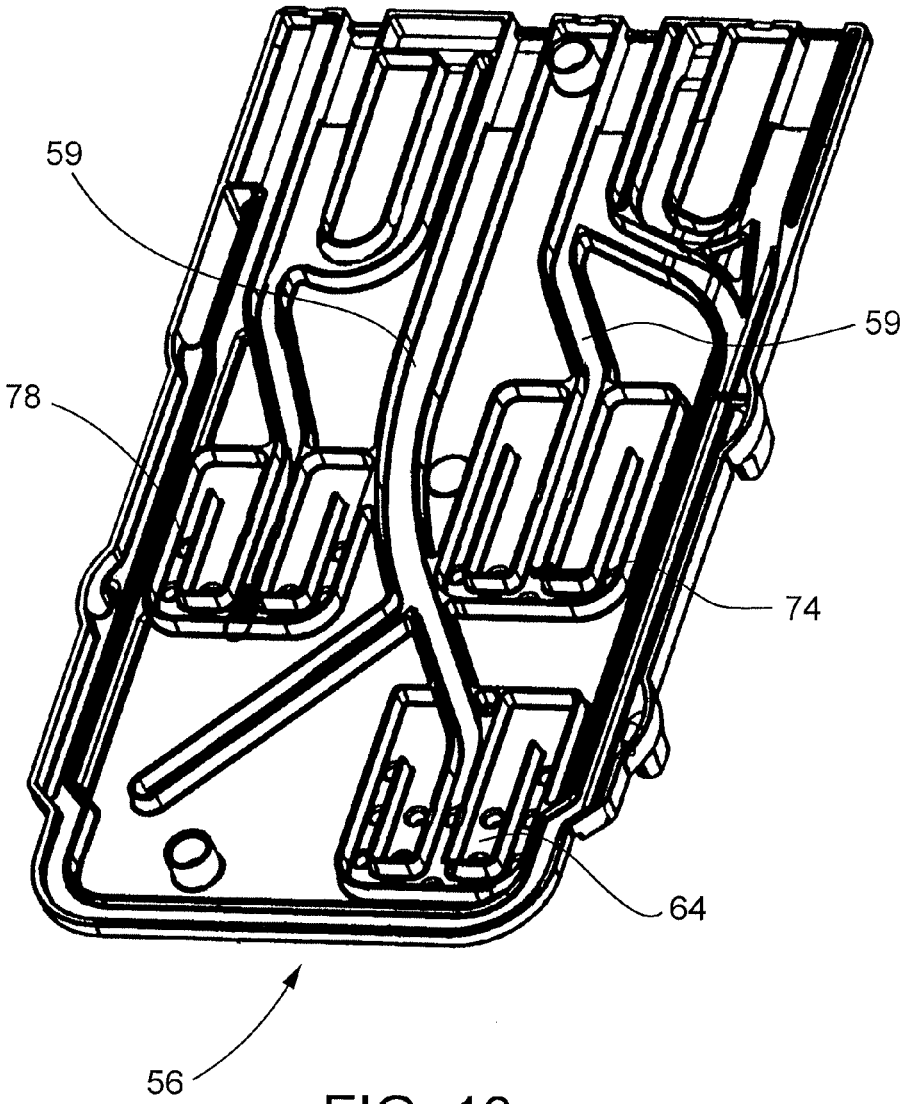
FIG. 13 is a perspective of a bottom panel of the dispenser top shown in FIG. 12.
Figure 14:
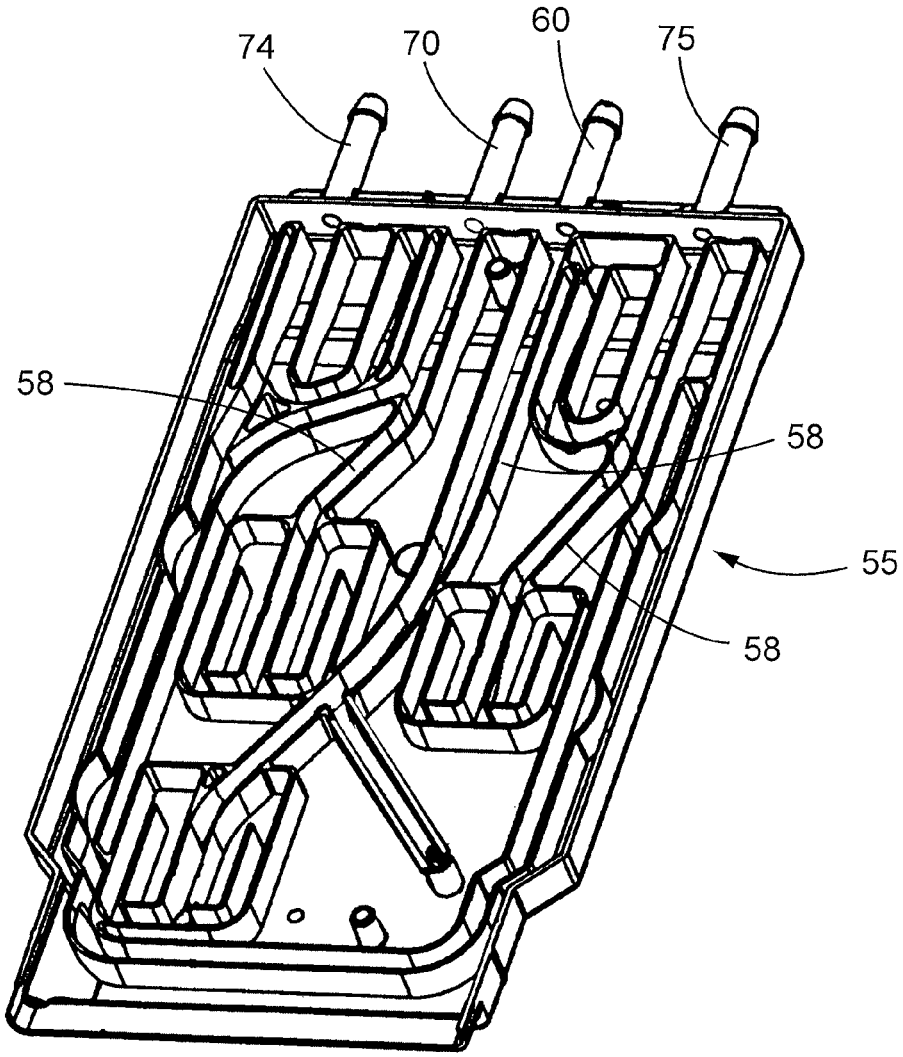
FIG. 14 is a perspective of a top panel of the dispenser top shown in FIG. 12.

For facilitating complete dispensing of the bleach and softener from the compartments 46, 48, respectively, each of these compartments includes a respective siphoning structure through which softener and bleach is respectively directed for discharge into the dispenser housing bottom 26 and ultimate direction into the wash tub 14. The bleach and softener compartments 46, 48 in this instance each have a respective upstanding cylindrical siphoning tube 85, 86 (FIGS. 7 and 10) that communicate with the dispenser housing bottom 26 and the tray insert 50 is formed with corresponding closed top, downwardly opening cylindrical projections or columns 88, 89 (FIGS. 8 and 9) that are positionable over the siphoning tubes 85, 86 as an incident to mounting of the insert 50 on the tray 25. The tray insert 50 is supported with the bottom of the cylindrical projections 88, 89 in slightly elevated relation to the bottom of the siphoning tubes 85, 86 for defining water flow passageways under the projections 88, 89 into an annular siphoning flow passageway between each siphoning tube 85, 86 and cylindrical projection 88, 89. As water is introduced into the bleach compartment 46, for example, it mixes with the chemical within the compartment as the liquid level rises upwardly about the siphoning tube 85. Once the liquid level rises above the top of the siphoning tube 85, water mixed with the chemical enters the top of the siphoning tube for direction into the bottom 26 of the dispenser housing 20 and through the outlet 36 for direction to the wash tub 14 with the siphoning action ultimately completely draining all the chemical from the chamber. It will be understood that the softener is completely dispensed from the softener compartment 48 with a similar siphoning action.

In accordance with an important feature of the invention, the soap and chemical dispenser is adapted for efficient cleaning of residual soap and chemicals from the tray and housing for enhanced maintenance-free operation. More particularly, the dispenser 11 is adapted for regular automatic washing of the tray 25 and dispenser bottom 26 with clean water free of dispensed soap and chemicals during each washing operation of the machine. To this end, in the illustrated embodiment, the prewash passageway 71 communicates with a flushing passageway 90 that extends about a substantial portion of a perimeter of the dispensing top 35 for communicating flushing water to a plurality of flush ports 91 for direction about the adjacent walls of the tray 25 and dispenser bottom 26. The flushing passageway 90 in this case is generally U-shaped, extending along one side wall of the housing top 35 in communication with two flush ports 91, about a front end of the housing top 35, and rearwardly along the opposite side wall in communication with two additional flush ports 91. In the illustrated embodiment, the flush ports 91 direct water into respective flush channels 92 formed in the side walls 29 of the dispenser housing bottom 26. The channels 92 in this case are outwardly extending channels in the side walls 29, which curve downwardly and inwardly for directing the water inwardly about the sides and underside of the housing bottom 26. Since the side walls 29 of the housing bottom 26 taper inwardly toward each other, residual soap and chemicals also are flushed and removed from the those surfaces. It will be appreciated by one skilled in the art that since the flushing water is communicated directly from the prewash water inlet 70, clean water free of dispensed soap and chemicals is directed through the flush ports 91 during each cycle of operation of the washing machine so as to maintain the outer sides of the tray and the inner side walls of the dispenser bottom free of accumulated soap and chemicals. It will also be understood that an additional flushing cycle could be programmed following completion of each washing operation for additional rinsing and cleaning of the dispenser tray and bottom surfaces following each usage.

For cleaning the rear end wall of the tray 25, and rear wall 30 of the dispenser bottom 26, the softener water passageway 76 in this case further communicates with a rear wall flushing passage 95 that communicates with a flushing port 96 adjacent a rear end of the dispenser top 35 for directing water between the rear of the dispenser tray 25 and the rear wall 30 of the dispenser bottom 26.

Figure 16:
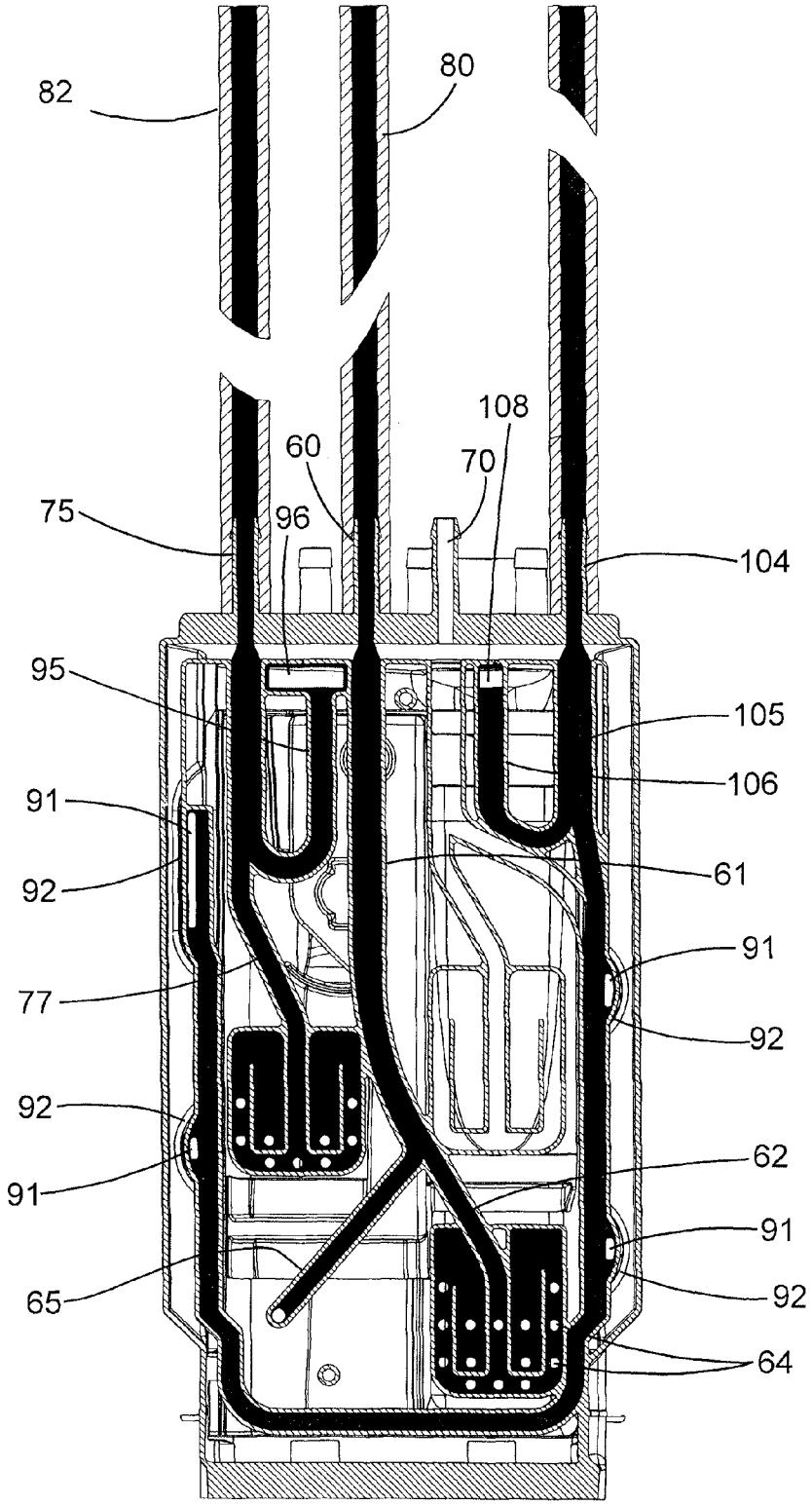
FIG. 16 is a diagrammatic depiction, similar to FIG. 15, but showing an alternative embodiment of the dispenser operation.

Referring now to FIG. 16, there is shown an alternative embodiment of soap and open chemical dispenser 11, wherein items similar to those described above have been given similar reference numerals. This embodiment is similar to that described above, except the tray insert 50 does not include a prewash soap compartment 51 and the prewash inlet 70 is not connected to a water supply line. The dispenser top 35, utilizes a separate flushing water inlet 104, not employed in the previously described embodiment, that communicates water through a perimeter flushing passageway 105 about the sides and the front end of the dispenser top 35 and a further passageway 106 that communicates with the flushing passageway 105 rearwardly to a flushing port 108 for directing water between rear sides of the tray 25 and housing bottom 26 to the right of the flushing port 96 as viewed in FIG. 16. Otherwise, the dispenser operation is similar to the previously described embodiment.

From the foregoing, it can be seen that the soap and chemical dispenser of the present invention is adapted for more reliable maintenance free operation by automatically directing clean water free of dispensed soap and chemicals during each cycle of operation for removing residue soap and chemicals on the dispenser tray and housing bottom. The soap and chemical dispenser, furthermore, is of relatively compact simple design which lends itself to economical manufacture and does not alter the drum capacity of the machine.

The invention claimed is:

1. A washing machine comprising:

a cabinet, a wash tub within said cabinet for receiving wash water during a washing operation, a rotatably-driven basket within said wash tub for receiving launderable items for washing, a soap and chemical dispenser disposed within said cabinet, said dispenser having a housing with a bottom having an outlet for communicating water and chemicals from said dispenser to said wash tub during a washing operation, said dispenser having a tray with a plurality of upwardly opening compartments, one of said compartments being a soap compartment for receiving soap for use in a main wash operation of the machine, and at least one of said compartments being a chemical compartment for receiving a chemical for use during a washing operation, said tray being movable between an operative position within said cabinet in overlying relation to said housing bottom and a withdrawn position outwardly of said cabinet for enabling the deposit of soap and chemicals into said compartments, said dispenser having a top mounted in overlying relation to said tray having a plurality of water inlets communicating with a plurality of water passageways, one of said water passageways being a main wash water passageway having an outlet for directing water into said soap compartment of said tray for mixing with soap and overflowing into the dispenser bottom for direction to said wash tub, one of said passageways being a chemical dispensing water passageway having an outlet for directing water to said chemical compartment of said tray for mixing with a chemical additive in the compartment and in turn for direction into said dispenser bottom and said wash tub, and at least one of said water passageways being a flush water passageway having a plurality of flush water outlet ports adjacent an outer perimeter of the dispenser top and at locations outside the perimeters of said compartments for directing water free of soap and chemicals contained within said compartments into the dispenser housing bottom for flushing of the dispenser housing bottom with water free of soap and chemicals dispensed during a washing operation.

2. The washing machine of claim 1 in which said dispenser top comprises upper and lower panels that mate to define said water passageways.

3. The washing machine of claim 1 in which both said panels are formed with channels that mate to define said water passageways.

4. The washing machine of claim 1 in which said tray includes a plurality of chemical additive compartments including a softener compartment and a bleach compartment, one of said passageways having an outlet for communicating water to said softener compartment for discharge into said dispenser bottom and to said wash tub, and one of said passageways having an outlet for communicating water to said bleach compartment for direction into said dispenser bottom and to said wash tub.

5. The washing machine of claim 4 in which at least some of said passageways communicate with a common water inlet.

6. The washing machine of claim 1 in which said flush water passageway includes legs that extend along opposite sides of said dispenser top, and said flush water passageway legs each having at least two said flush water outlet ports.

7. The washing machine of claim 6 in which said dispenser top includes a second flush water passageway communicating with a flush water outlet port adjacent a rear end of said top for dispensing flush water free of soap and chemicals dispersed during a washing operation between a rear side of the dispenser tray and a rear wall of the housing bottom.

8. The washing machine of claim 4 in which said water passageways include a second flush water passageway communicating with a water inlet via said softener dispensing water passageway and having an outlet port adjacent a rear end of said dispenser top.

9. The washing machine of claim 4 in which said bleach dispensing water passageway communicates with one of said water inlets via the main wash water passageway.

10. The washing machine of claim 1 in which said flush water passageway includes side legs adjacent opposite sides of said dispenser top and an end leg disposed adjacent a front end of said dispenser top interconnecting said side legs, and including a second flush water passageway connected to one of said water inlets separate from the water inlet to which the flush water passageway is connected and communicating with a flush water outlet port adjacent a rear end of said dispenser top.

11. The washing machine of claim 4 in which each said softener and bleach compartments each has a siphoning structure for siphoning water and softener and bleach from the respective compartment as an incident to dispensing of softener and bleach to the housing bottom.

12. The washing machine of claim 11 in which said siphoning structure includes an upstanding siphoning tube in each said softener and bleach compartment each communicating with the dispenser bottom, and a closed top cylindrical cover column disposed in overlying relation to each siphoning tube for defining a siphoning flow passage between an underside of the closed top cover column, between the siphoning tube and cover column, and through said siphoning tube to said housing bottom.

13. The washing machine of claim 1 in which said tray includes a prewash compartment for receiving and dispensing soap during a prewash cycle of operation of the machine, and one of said water passageways has an outlet for directing water into said prewash compartment during a prewash cycle of operation.

14. The washing machine of claim 1 in which said dispenser is disposed behind a front panel of said cabinet with said tray being movable to a loading position forwardly of said front panel.

15. The washing machine of claim 14 in which said basket is rotatable about a horizontal axis of rotation.

16. A washing machine comprising:

a cabinet, a wash tub within said cabinet for receiving wash water during a washing operation, a rotatably-driven basket within said wash tub for receiving launderable items for washing, a soap and chemical dispenser disposed within said cabinet, said dispenser having a housing with a bottom having an outlet for communicating water and chemicals from said dispenser to said wash tub during a washing operation, said dispenser having a tray with a plurality of upwardly opening compartments, one of said compartments being a soap compartment for receiving soap for use in a main wash operation of the machine, and at least one of said compartments being a chemical compartment for receiving a chemical for use during a washing operation, said tray being movable between an operative position within said cabinet in overlying relation to said housing bottom and a withdrawn position outwardly of said cabinet for enabling the deposit of soap and chemicals into said compartments, said dispenser having a top mounted in overlying relation to said tray having a plurality of water inlets communicating with a plurality of water passageways, one of said water passageways being a main wash water passageway having an outlet for directing water into said soap compartment of said tray for mixing with soap and overflowing into the dispenser bottom for direction to said wash tub, one of said passageways being a chemical dispensing water passageway having an outlet for directing water to said chemical compartment of said tray for mixing with a chemical additive in the compartment and in turn for direction into said dispenser bottom and said wash tub, and at least one of said water passageways being a flush water passageway having a substantial u-shaped section with side legs adjacent opposite sides of the dispenser top and an end leg adjacent a forward end of the dispenser top interconnecting said side legs, and said flush water passageway side legs each having at least two flush water outlet ports adjacent an outer perimeter of the dispenser top for flushing of the dispenser housing bottom with water free of soap and chemicals dispensed during a washing operation.

17. A washing machine comprising:

a cabinet, a wash tub within said cabinet for receiving wash water during a washing operation, a rotatably-driven basket within said wash tub for receiving launderable items for washing, a soap and chemical dispenser disposed within said cabinet, said dispenser having a housing with a bottom having an outlet for communicating water and chemicals from said dispenser to said wash tub during a washing operation, said dispenser having a tray with a plurality of upwardly opening compartments, one of said compartments being a soap compartment for receiving soap for use in a main wash operation of the machine, and at least one of said compartments being a chemical compartment for receiving a chemical for use during a washing operation, said tray being movable between an operative position within said cabinet in overlying relation to said housing bottom and a withdrawn position outwardly of said cabinet for enabling the deposit of soap and chemicals into said compartments, said dispenser having a top mounted in overlying relation to said tray having a plurality of water inlets communicating with a plurality of water passageways, one of said water passageways being a main wash water passageway having an outlet for directing water into said soap compartment of said tray for mixing with soap and overflowing into the dispenser bottom for direction to said wash tub, one of said passageways being a chemical dispensing water passageway having an outlet for directing water to said chemical compartment of said tray for mixing with a chemical additive in the compartment and in turn for direction into said dispenser bottom and said wash tub, at least one of said water passageways being a flush water passageway having a plurality of flush water outlet ports adjacent an outer perimeter of the dispenser top, and said dispenser housing bottom being formed with flush channels into which water from said flush water outlet ports discharge for flushing of the dispenser housing bottom with water free of soap and chemicals dispensed during a washing operation.

* * * * *